US011213183B2

(12) United States Patent
Nadeau

(10) Patent No.: US 11,213,183 B2
(45) Date of Patent: Jan. 4, 2022

(54) PORTABLE DEVICE FOR RECEIVING A LIQUID FROM A FLOOR SURFACE OR THE LIKE USING A SQUEEGEE

(71) Applicant: Nadeau Design Inc., Montreal (CA)

(72) Inventor: Claude Nadeau, Montreal (CA)

(73) Assignee: Nadeau Design Inc., Montreal (CA)

( * ) Notice: Subject to any disclaimer, the term of this patent is extended or adjusted under 35 U.S.C. 154(b) by 438 days.

(21) Appl. No.: 16/349,327

(22) PCT Filed: Oct. 30, 2017

(86) PCT No.: PCT/CA2017/000234
§ 371 (c)(1),
(2) Date: May 13, 2019

(87) PCT Pub. No.: WO2018/090126
PCT Pub. Date: May 24, 2018

(65) Prior Publication Data
US 2019/0343364 A1 Nov. 14, 2019

(30) Foreign Application Priority Data
Nov. 16, 2016 (CA) ..... CA 2948502

(51) Int. Cl.
*A47L 13/52* (2006.01)
*A47L 13/11* (2006.01)
(Continued)

(52) U.S. Cl.
CPC ..... *A47L 13/11* (2013.01); *A47L 13/12* (2013.01); *A46B 15/0055* (2013.01);
(Continued)

(58) Field of Classification Search
CPC ..... A47L 13/11; A47L 13/12; A47L 13/52; A47L 13/512; A46B 15/0055; A46B 2200/3033
See application file for complete search history.

(56) References Cited

U.S. PATENT DOCUMENTS 346,761 A * 8/1886 Marsh et al. ..... A47L 13/52 15/257.3
389,366 A * 9/1888 Cunningham ..... A47L 13/52 15/257.3
(Continued)

FOREIGN PATENT DOCUMENTS

CN 201780077961.4 8/2020
CN 201780077961.4 3/2021
(Continued)

*Primary Examiner* — Weilun Lo
(74) *Attorney, Agent, or Firm* — Agence de Brevets Fournier

(57) ABSTRACT

A portable device for receiving a liquid from a floor via a squeegee or another scraping implement includes a container having a bottom and an opening that is distanced from the bottom, a ramp that extends from the opening of the container to a position generally levelled with the bottom, the ramp being adapted to receive the squeegee in a scraping movement thereon, and a handle portion that is more distanced from the bottom of the container than the opening thereof. The handle portion is adapted to receive a blade portion of the squeegee in order to move the device therewith.

24 Claims, 19 Drawing Sheets

(51) Int. Cl.
*A47L 13/12* (2006.01)
*A46B 15/00* (2006.01)
*A47L 13/512* (2006.01)

(52) U.S. Cl.
CPC ..... *A46B 2200/3033* (2013.01); *A47L 13/512* (2013.01); *A47L 13/52* (2013.01)

(56) References Cited

U.S. PATENT DOCUMENTS 675,052 A * 5/1901 Carlson ..... A47L 13/52 15/257.2
1,255,902 A * 2/1918 Marriott ..... A47L 13/52 15/257.3
1,748,336 A * 2/1930 Finnell ..... A47L 13/52 15/257.3
3,002,209 A * 10/1961 McKinstry ..... A47L 13/11 15/1
3,056,992 A * 10/1962 Clough ..... A47L 13/52 15/257.3
5,012,542 A * 5/1991 Lynn ..... A47L 13/11 15/1
5,715,564 A * 2/1998 Knouse ..... A47L 13/52 15/257.1
6,282,745 B1 * 9/2001 Alt ..... A47L 13/52 15/257.4
6,477,733 B1 * 11/2002 Kuhns ..... A47L 13/52 15/257.3
8,904,589 B2 * 12/2014 Santarsiero ..... A47L 13/12 15/105
2003/0167588 A1 * 9/2003 Perelli ..... A47L 13/52 15/257.7
2013/0269129 A1 * 10/2013 Santarsiero ..... A47L 5/36 15/117

FOREIGN PATENT DOCUMENTS

CN 201780077961.4 6/2021
EP 17872511.5 7/2020
WO WO PCT/CA2017/000234 1/2018

* cited by examiner

PORTABLE DEVICE FOR RECEIVING A LIQUID FROM A FLOOR SURFACE OR THE LIKE USING A SQUEEGEE

FOREIGN PRIORITY CLAIM

This is a 35 U.S.C. § 371 application of, and claims priority to, International Application No. PCT/CA2017/000234, which was filed on Oct. 30, 2017, and published as Publication No. WO 2018/090126A1, which claims priority to Canadian Patent Application No. 2,948,502, which was filed on Nov. 16, 2016, the entirety of all the applications are incorporated herein by reference.

FIELD

The present disclosure relates to portable containers for receiving liquid from a floor. More specifically, the present disclosure relates to a portable device for receiving a liquid from a surface using a squeegee.

BACKGROUND

Many devices and implements are known in the field of cleaning. Regarding floor caring, the use of a dustpan is known for a very long time to receive and carry to a trashcan dust and small debris. However, neither the dustpan nor a broom that should be used therewith is suitable to collect water on a floor. Conventionally, either a wet vacuum cleaner or a bucket with a mop is used for such purposes. However, both are unsuitable to collect a large quantity of liquid on a floor; the former is slow and unpractical in many applications, considering among other things that it needs to be plugged, and the latter is too slow when it comes to collect a large quantity of liquid.

A device that allows collecting a large quantity of liquid on a floor and that is also portable is therefore desired.

SUMMARY

According to an illustrative embodiment, there is provided a device for receiving a liquid from a floor via a squeegee, the device comprising:

a container having a bottom and an opening that is distanced i) from the bottom and ii) from a longitudinal center of the container;

a ramp that extends from the opening of the container to a position generally levelled with the bottom; the ramp being adapted to receive the squeegee in a scraping movement thereon; and a handle that is more distanced from the bottom of the container than the opening thereof; the handle being adapted to receive a blade portion of the squeegee so as to move the device therewith.

It is to be noted that the expression liquid should be construed in the description and in the claim as to include a material in pure liquid form or a mixed of one or more material in liquid form including debris or pieces of solid material therein.

Other objects, advantages and features of the present invention will become more apparent upon reading the following non restrictive description of illustrated embodiments thereof, given by way of example only with reference to the accompanying drawings.

DETAILED DESCRIPTION

Figure 1:
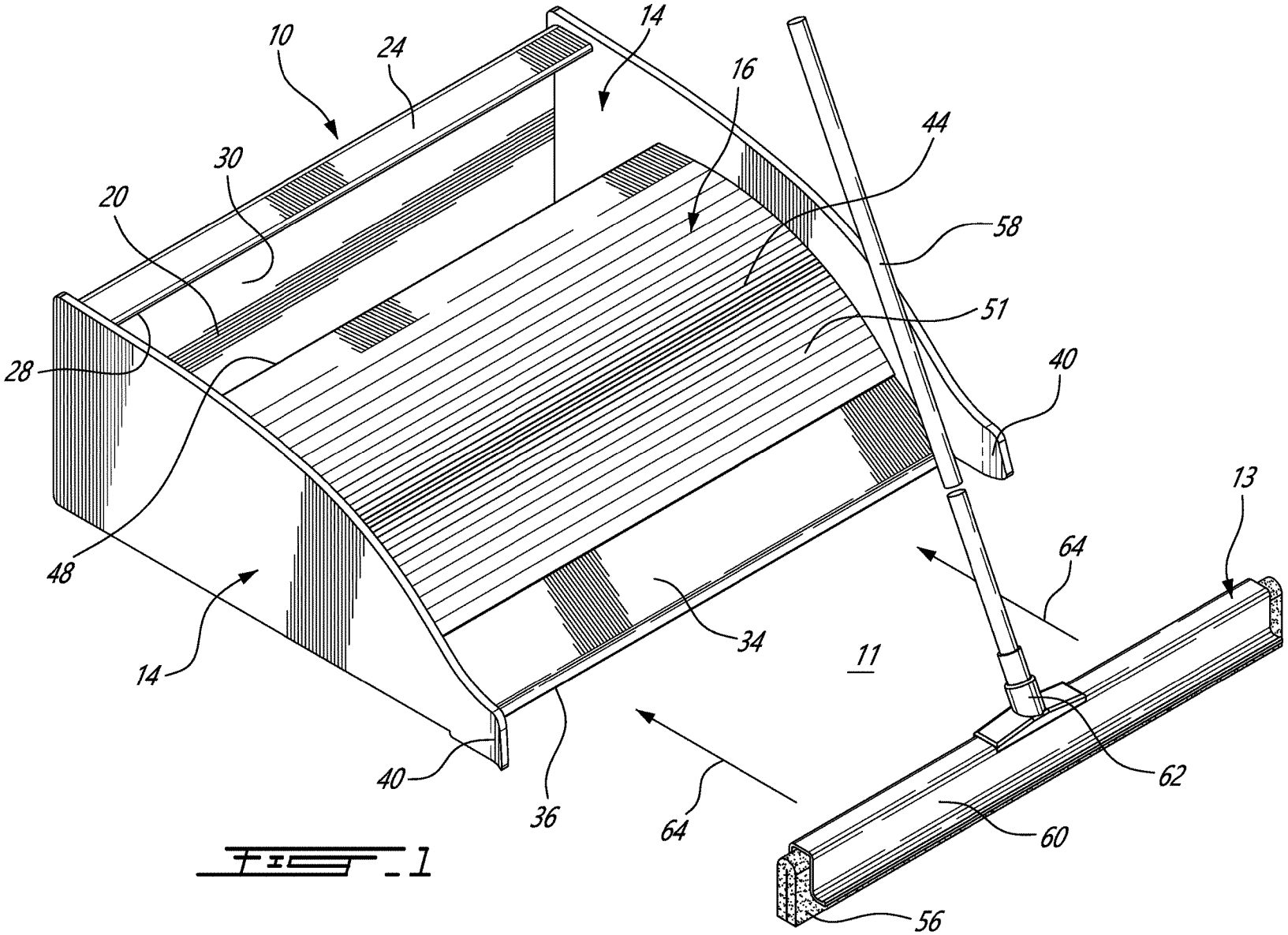
FIG. 1 is a perspective view of a portable device for receiving a liquid from a surface according to a first illustrated embodiment; the device being illustrated with a squeegee adjacent thereto.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

An illustrative embodiment of a device 10 for receiving a liquid from a floor 11 will now be described with references first to FIGS. 1 and 2.

Figure 2:
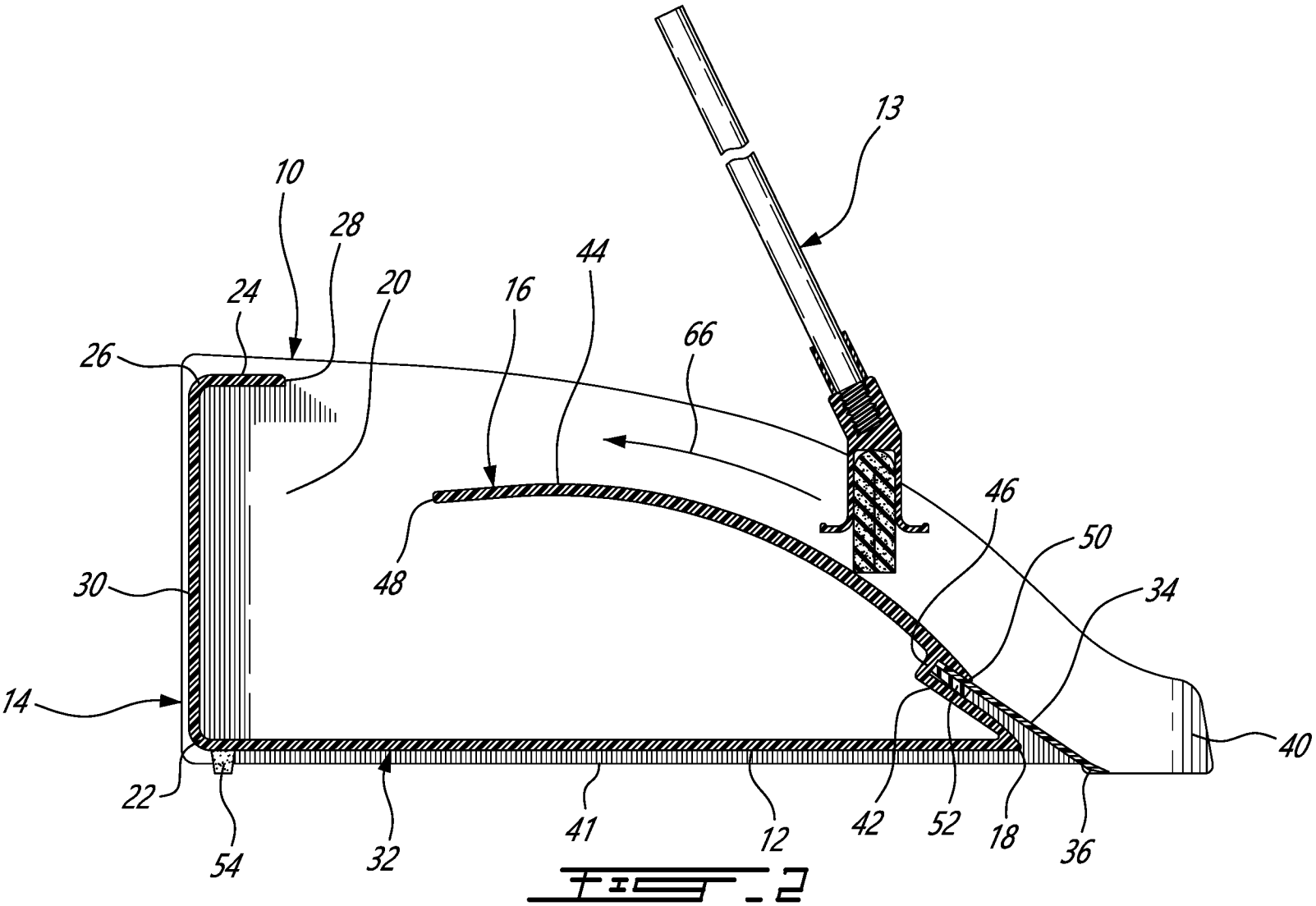
FIG. 2 is a cross-section of the device from FIG. 1, illustrated with a squeegee in a movement for operatively moving liquid therein.

As shown in FIGS. 1 and 2, the device 10 is configured to be used with a squeegee 13.

The device 10 is in the form of a container having a bottom wall 12, two side walls 14 secured to the two lateral side edges of the bottom wall 12 so as to extend generally perpendicularly and upwardly therefrom, a generally arcuate top wall 16 that defines a ramp extending from a first longitudinal side edge 18 of the bottom wall 12 between both side walls 14, a back wall 30 that extends generally perpendicularly from a second longitudinal side edge 22 of the bottom wall 12, and a flange 24 that extends shortly from the edge 26 of the back wall 30 between both side walls 14 so as to be in a generally parallel relationship with the bottom wall 12.

The free edge 28 of the flange 24 is distanced from the ramp 16 both longitudinally and upwardly, defining with the ramp 16 an opening 20 of the container therebetween. The opening 20 is distanced from a longitudinal center of the container 10.

As will become more apparent upon reading the following description, the ramp 16 defines a smooth surface for bringing the liquid (not shown) from the floor 11 to the opening 20 using the squeegee 13, in a scraping movement thereon.

According to the first illustrated embodiment, the container 10 is assembled from a one-piece center portion 32 that defines the ramp 16, the bottom wall 12, the back wall 30, and the flange 24, from the two side walls 26 and from a disposable blade 34 that is removably mounted to the center portion 32 and that defines the bottom edge 36 of the ramp 16.

With reference more specifically to FIG. 2, the center portion 32 is defined by a one-piece extruded generally shoe-shaped bended wall having a generally uniform thickness.

The two side walls 14 are sealingly secured on each lateral side of the center portion 32 using plastic welding, press fitting, fasteners or an adhesive.

The side walls 14 are tapered and shaped similarly to the overall contour of the center portion 32. The side walls 14 are however configured to be oversized relatively to the center portion 32 so as to extend upwardly, downwardly and longitudinally therefrom.

The portions 40 of the side walls 14 that extend longitudinally beyond the bottom edge of the ramp 16 are bent laterally outwardly so as to define a widened entrance for the squeegee 13. This has been found to facilitate the raising of the squeegee 13 onto the ramp 16 towards the opening 20 of the container 10. Also, the portions 40 extends downwardly beyond the longitudinal edge 41 of the side walls 14.

The arcuate ramp 16 includes a first generally straight portion 42 that integrally extends from the bottom wall 30 and that is slanted towards the back wall 30.

The ramp 16 further includes an arcuate portion 44 that is integrally mounted to the straight portion 42 via a bridge portion 46. The arcuate portion 44 of the ramp 16 is configured so that its free edge 48, adjacent the opening 16, is oriented slightly downwardly. This feature, combined with the back wall 30 extending higher than the edge 48 of the ramp 16 and with the presence of the flange 24, aims at limiting spillage of the liquid out of the container 10 when it is forcefully moved upward the ramp 16 towards the opening 20 using the squeegee 13.

The edge 50 of the arcuate portion 44 that is opposite the free edge 48 extends downwardly beyond the bridge 46, yielding a slot that is defined by the bridge 46, the straight portion 42 and arcuate portion 44 therebetween. The slot extends along the full width of the container 10 and defines a blade-receiving portion for the blade 34.

According to the first illustrated embodiment, the blade 34 is made of a polymeric material, such as for example polycarbonate. It is however not limited to such material. Its length is such that the blade 34 extends below the side walls 14 when the blade 34 is inserted at the bottom of the slot. Also, the lateral edges 51 of the blade 34 are unsecured to the side walls 14 for unrestricted movement relatively thereto. This assembly of the blade 34 causes it to be pressed against the floor 11 when the container 10 rests thereon, which yields a tight joint between the ramp 16 and the floor 11.

A rubber strip 52 is inserted in the slot under the blade 34 to contribute maintaining the blade 34 in place within the slot. The strip 52 can be made of another resilient material.

A person skilled in the art would now appreciate that the blade 34, which is subject to a lot of friction and thus wear, can be easily removed without tools and as such can be easily replaced or reversed when its wear is too important to yield an adequate joint between the container 10 and the floor 11.

According to another embodiment (not shown), the blade 34 is provided with a thicker edge for snuggly fitting into the slot, and the rubber strip 52 is omitted. The blade 34 can also be secured to the ramp 16, within the slot or directly onto the ramp 16, via fasteners or an adhesive.

According to still another embodiment, the ramp 16 is configured so as to have a smooth surface along its full length and the blade 34 is omitted.

According to the illustrated embodiment, the center portion 32 and side walls 14 are made of a translucid polymeric material such as polycarbonate. These components 16 and 32 are however not limited to this material and/or color. As mentioned hereinabove, the center portion 32 is made by extrusion, which has been found to both speed the center portion manufacturing process and facilitate the making of center portions 32, and therefore of container 10, of different width.

According to another embodiment (not shown), the side walls 14 are secured to the center portion 32 using fasteners, press fitting, an adhesive or else and the assembly is then conventionally sealed.

According to still another embodiment (not shown), the center portion 32 and side walls 14 are integral and result, for example, from a molding process.

The container 10 further includes two small rubber legs 54 that are secured to the bottom wall 12 thereunder near the back wall 30. The legs 54 cause the back portion of the bottom wall 12 to raise generally to the same level than the front portion thereof so that the bottom of the container 10 is generally leveled. The legs 54 further act as friction elements to contributed stabilizing the device 10 during use.

According to the first illustrated embodiment, the legs 54 are positioned laterally near the center of the container 10 so as to yield improved stability to the container 10, even on an uneven floor 11.

According to another embodiment, the legs 54 are made of another resilient or rigid material. According to still another embodiment, the legs 54 are omitted.

It is to be noted that the number, position and/or configuration of the legs 54 can be different than illustrated in the Figures.

The squeegee 13 includes a blade 56 made of a resilient material, such as rubber or foam, which is removably or fixedly mounted to a long handle 58 via a U-shaped bracket 60 that firmly receives the blade 56. The handle 58 is removably or fixedly secured to the bracket 60 via a mounting assembly 62. The bracket 60 includes two lateral bottom flanges 68. Since a squeegee is believed to be well-known in the art, it will not be described herein in more detail for concision purposes.

The width of the ramp 16 is such as to be substantially the same than the width of the squeegee blade 56 so as to maximize moving liquid onto the ramp 16.

The container 10 can be used with squeegees that are narrower than the ramp 16. The container 10 can also be used with any other scraping implement provided with a hook portion.

In operation, the container 10 is laid on the floor 11 adjacent or on a portion thereof having a liquid to pick up. The liquid can be of any nature and consistency and can also include debris.

The squeegee 13 is then moved towards the ramp 16 of the container 10 (see arrow 64 in FIG. 1) while the squeegee 13 is pressed onto the floor 11 in a conventional manner. This causes part of the liquid between the blade 56 of the squeegee 14 and the container blade 34 to be forced towards the ramp 16.

Moving the squeegee 13 onto the ramp 16 as illustrated in FIG. 2 (see arrow 66) causes the liquid to move from the ramp 16 to the opening 20.

While the operation of the device 10 is described with reference to liquid, the device 10 can also be used, along with a squeegee or else, to pick up granular or powder material such as, without limitation, sand.

The arcuate configuration of the ramp 16 gives strength thereto and more specifically yields resistance to pressure applied on the ramp 16 via the squeegee 13.

Figure 3:
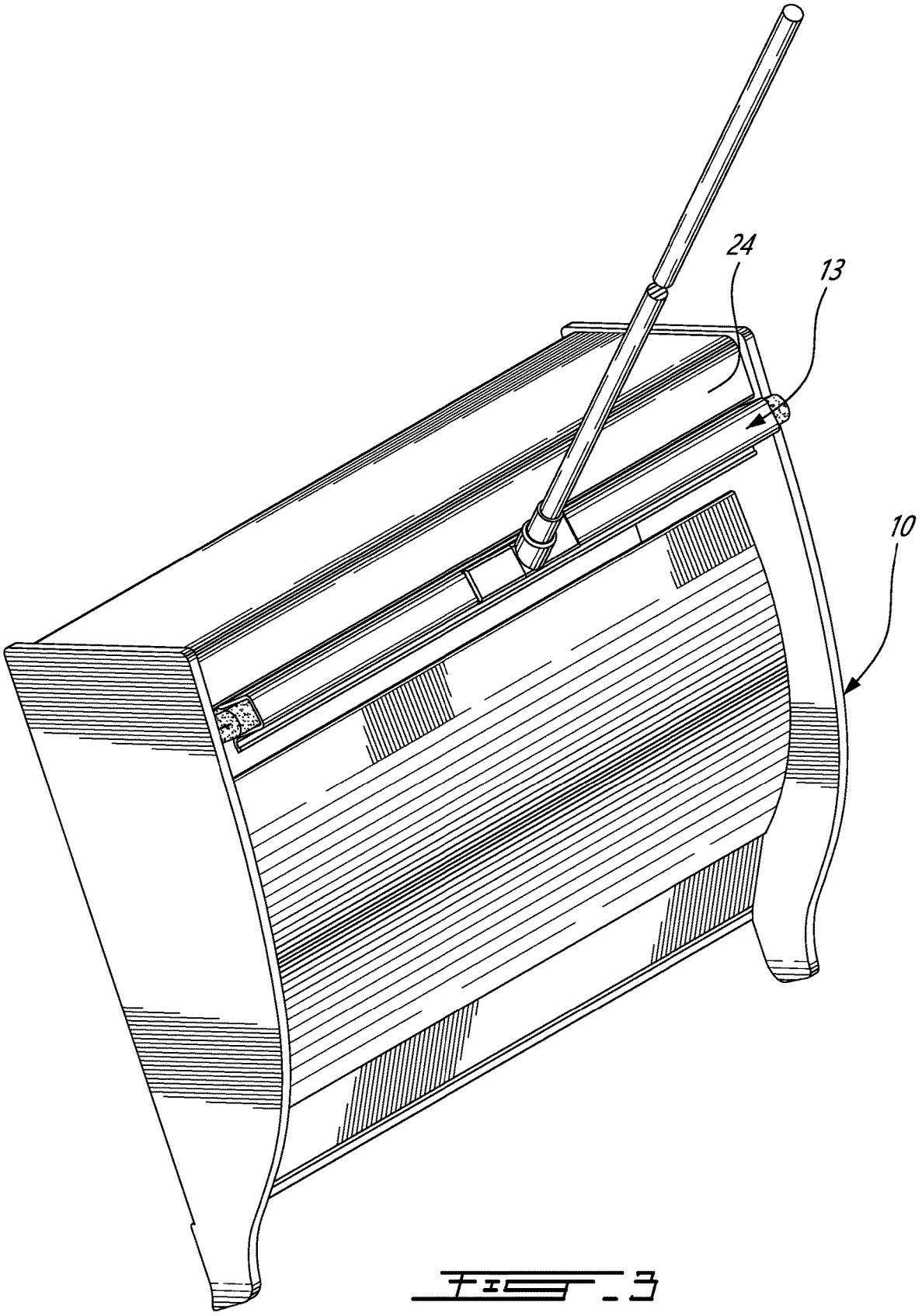
FIG. 3 is a perspective view of the device from FIG. 1; the device being shown as it is transported using the squeegee.
Figure 4:
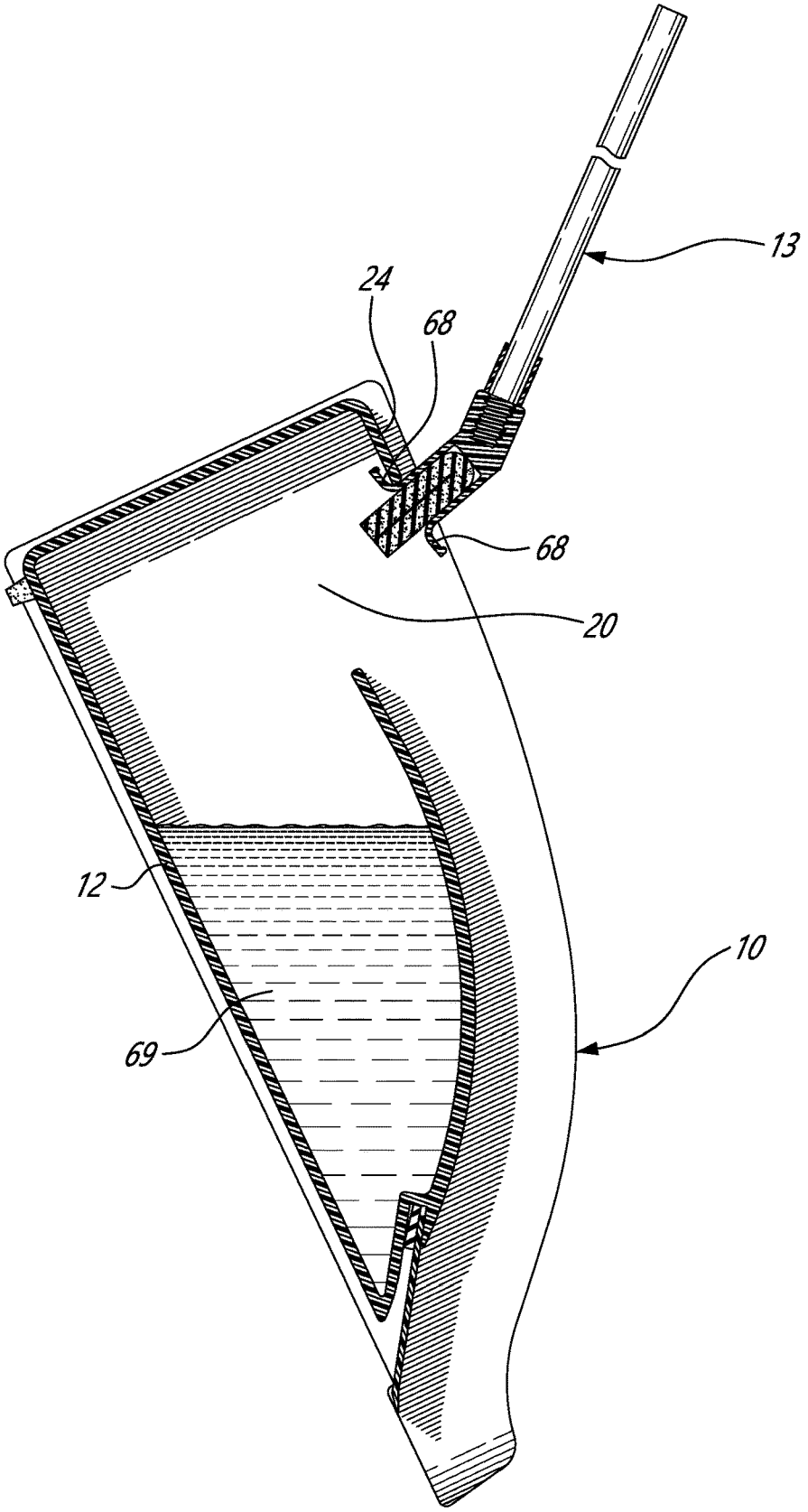
FIG. 4 is a cross section of the device from FIG. 1; the device being shown with liquid therein as it is transported using the squeegee.

As shown in FIGS. 3 and 4, the flange portion 24 yields a handle or hook portion that can be used to raise the container 10 from the floor 11 using a hand or the squeegee 13. More specifically, the bottom flanges 68 of the squeegee blade mounting bracket 60 can, for example, be used as a cooperating hook to grip the container 10 via the flange 24.

As can be seen more specifically in FIG. 4, the handle portion 24 is more distanced from the bottom 12 than from the opening 20 of the container 10. It results that, when the container 10 is raised by the handle portion 24, any liquid 69 within the container 10 moves towards the front of the container 10 and is prevented from spilling during transport thereof.

The container 10 can be easily emptied from its content either by pivoting it, for example using the squeegee 13, until the liquid 69 pours out therefrom from under the ramp 16, or by pivoting it the other side, whereby debris can be willingly kept in the container 10 by the flange 24 thereunder.

Figure 5:
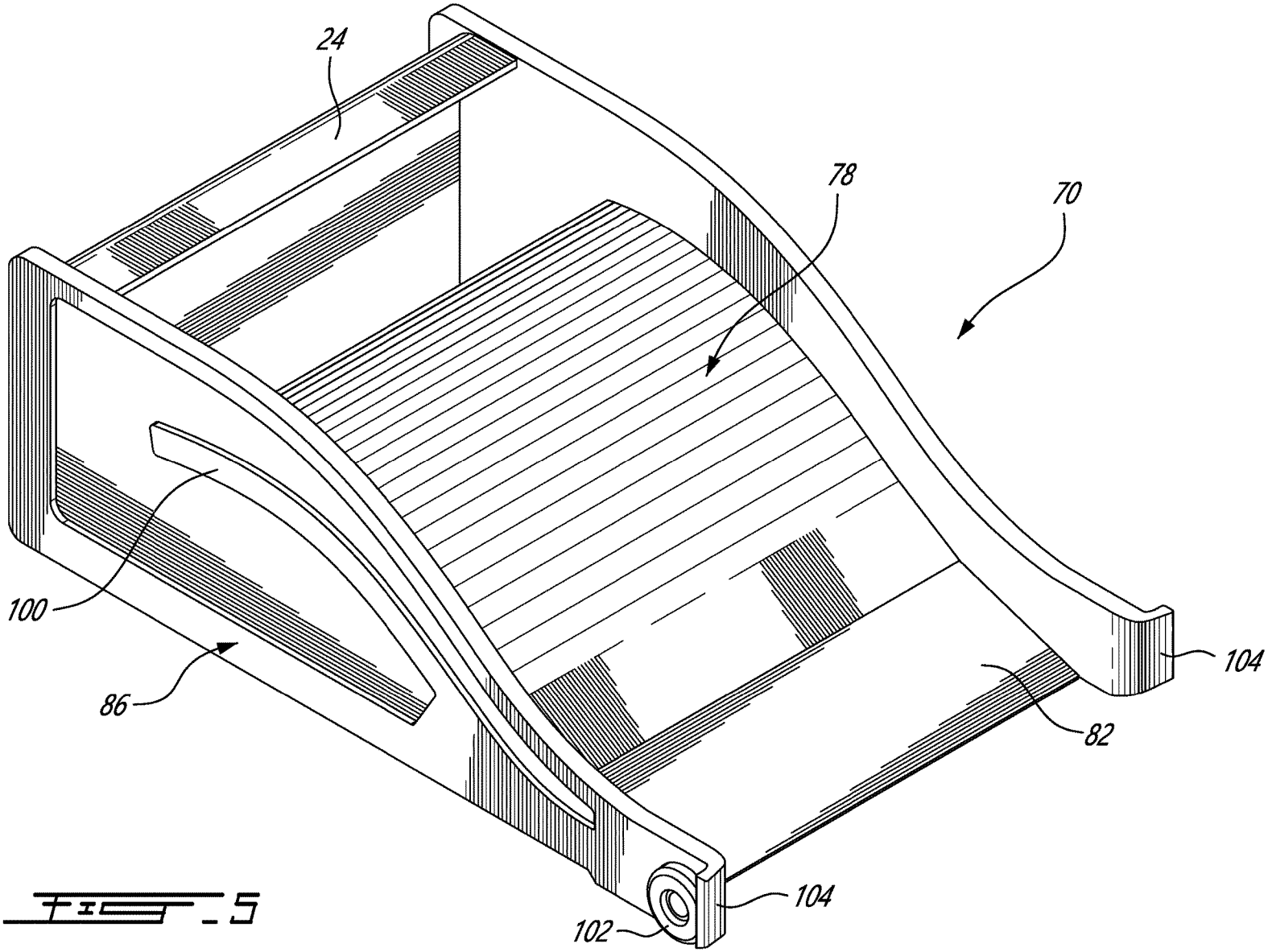
FIG. 5 is a perspective view of a portable device for receiving a liquid from a surface according to a second illustrated embodiment.
Figure 6:
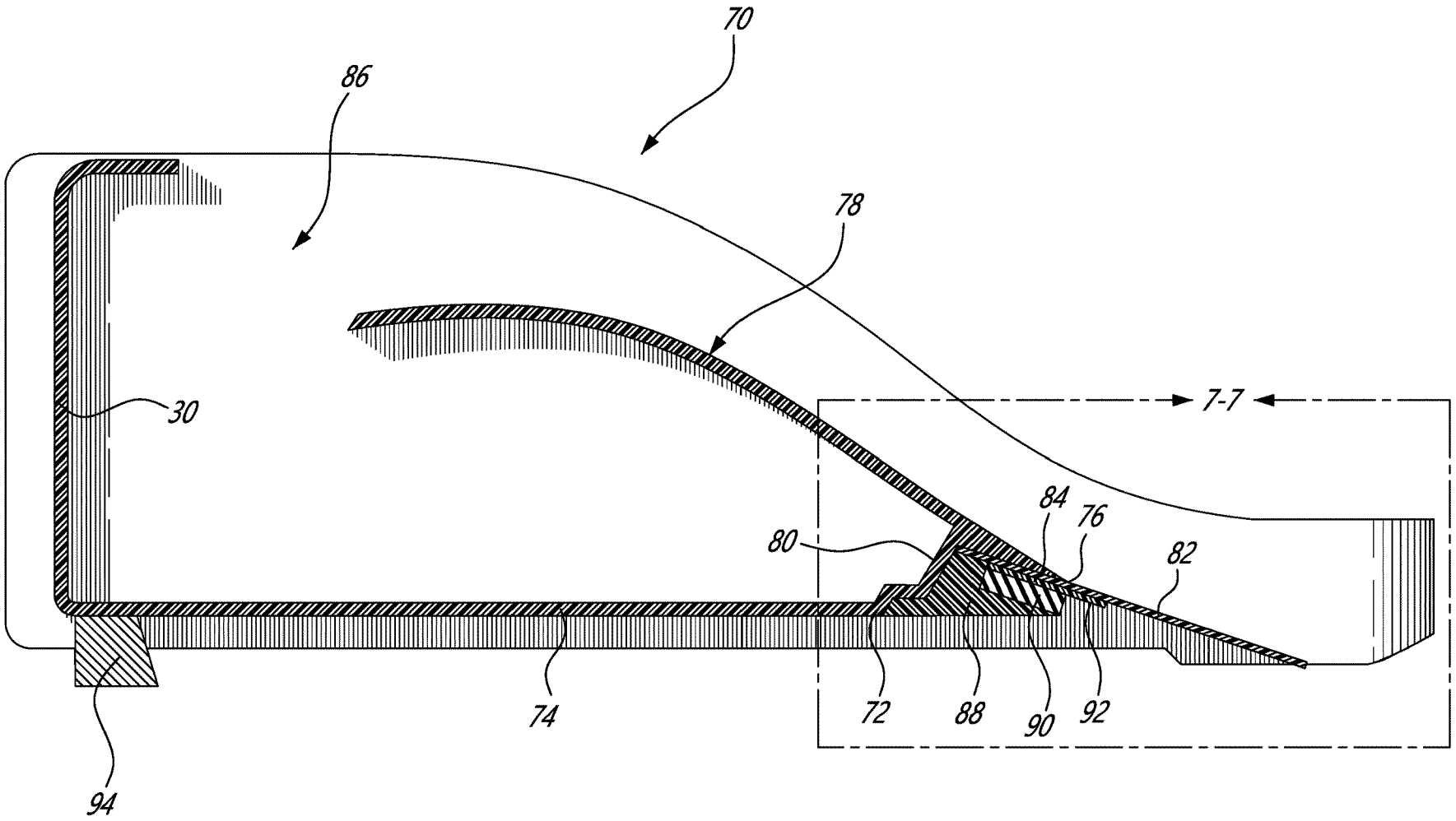
FIG. 6 is a cross-section of the device from FIG. 5.
Figure 7:
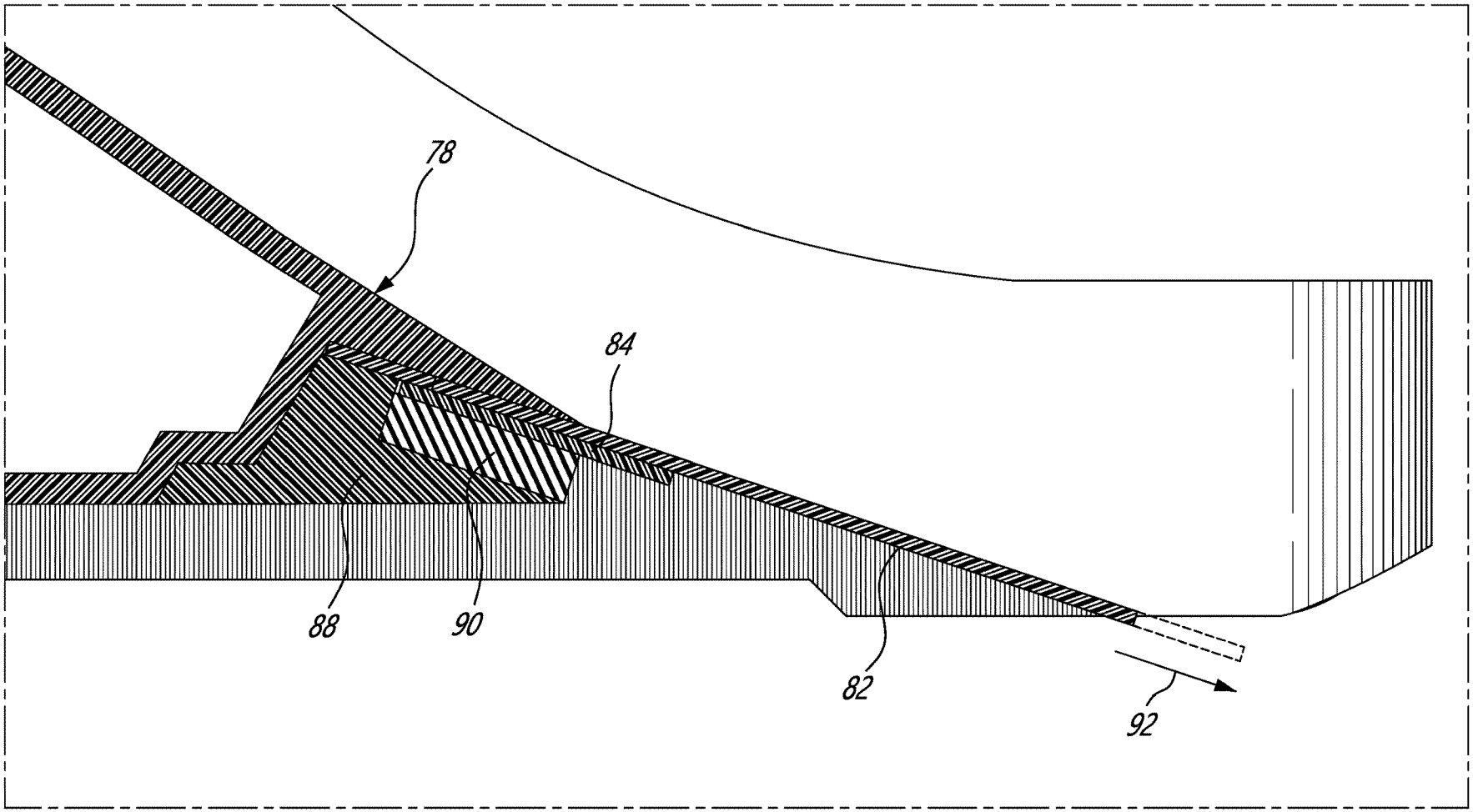
FIG. 7 is a close-up view taken within lines 7-7 in FIG. 6.

Turning now to FIGS. 5 to 7, a device 70 for receiving a liquid from a floor 11 according to a second illustrative embodiment will be described. Since the device 70 is similar to the device 10, only the differences therebetween will be described herein in more detail for concision purposes.

The frontal edge 72 of the bottom wall 74 is distanced from the distal edge 76 of the ramp 78 and is joined thereto by a hockey stick-shaped bridge 80. A blade 82 is received under the portion 84 of the ramp 78 that extends beyond the bridge 80. The length of the blade 82 is such that it extends beyond the side walls 86 thereunder.

The blade 82 is removably secured under the ramp 78 by a block 88 that is so shaped as to generally complement the space defined by the bridge 80 and the ramp 78 thereunder. The block 88 is secured to the bridge 80 using fasteners (not shown), press fitting or an adhesive. The block 88 further includes a recess on its side opposite the bridge 80 defining a slot that receives a pad 90 made of rubber or of another resilient and compressible material. The pad 90, along with a short strip 92 aims at maintaining the blade 82 in position under the ramp 78.

The two legs 54 are replaced by a single rubber leg 94 that is secured to the bottom wall 74 adjacent the back wall 30 and generally centered laterally. The width of the leg 94 is such as the leg 94 spans about a third to a fourth of the device's width.

The two legs 54 are replaced by a single rubber leg 94 that is secured to the bottom wall 74 adjacent the back wall 20 and generally centered laterally. The width of the leg 94 is such as the leg 94 spans about a third to a fourth of the device's width.

According to another embodiment, the leg 94 is made of another resilient or rigid material than rubber.

Figure 9:
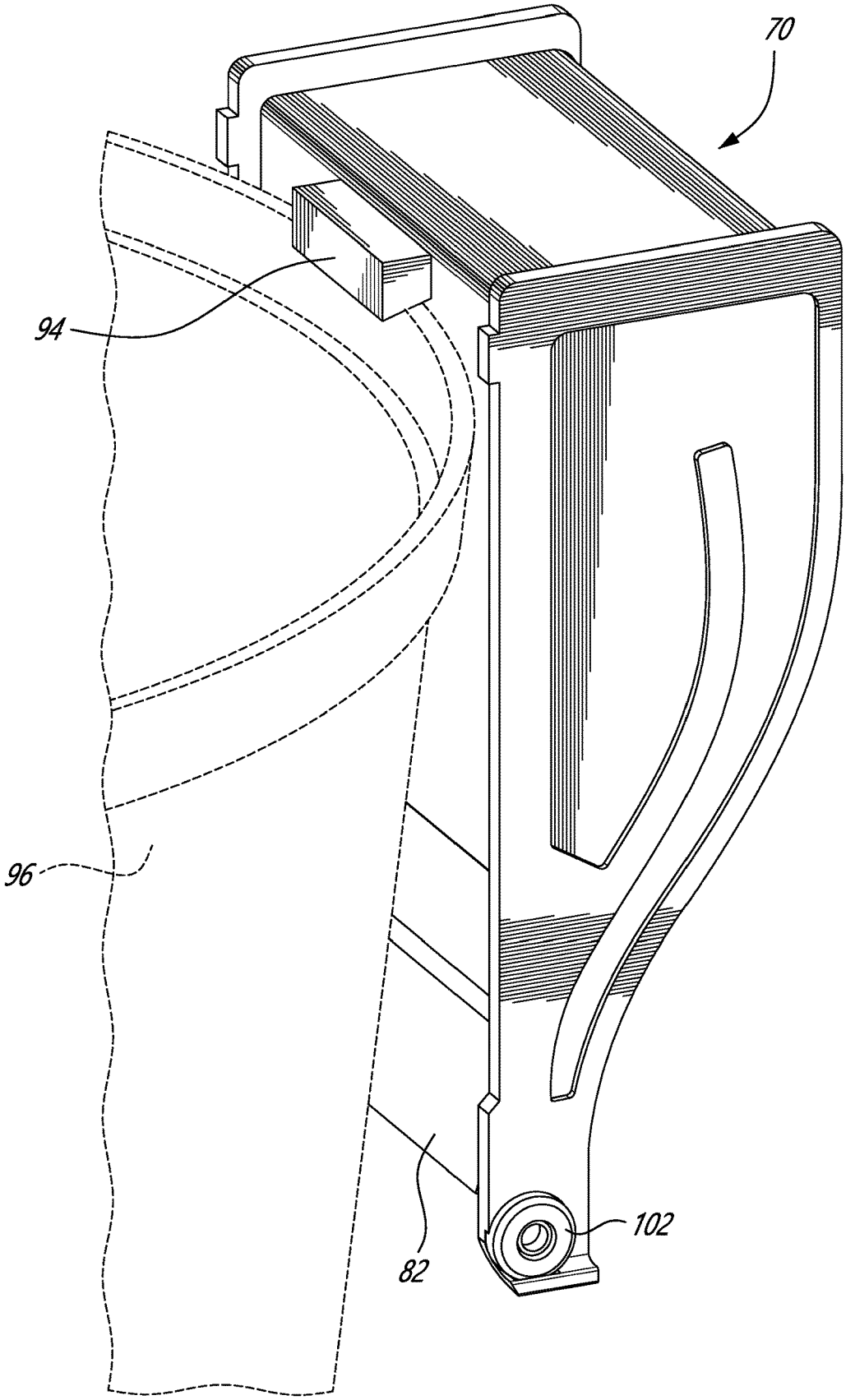
FIG. 9 is a perspective view showing the device hanging from a bucket.

The leg 94 is tapered so as to present a greater section on its free side than on its side contacting the bottom wall 74. As illustrated in FIG. 9, these configuration and position of the leg 94 allows its use as a hook to hang the device 70 to a bucket 96 or else for its transport.

Figure 10:
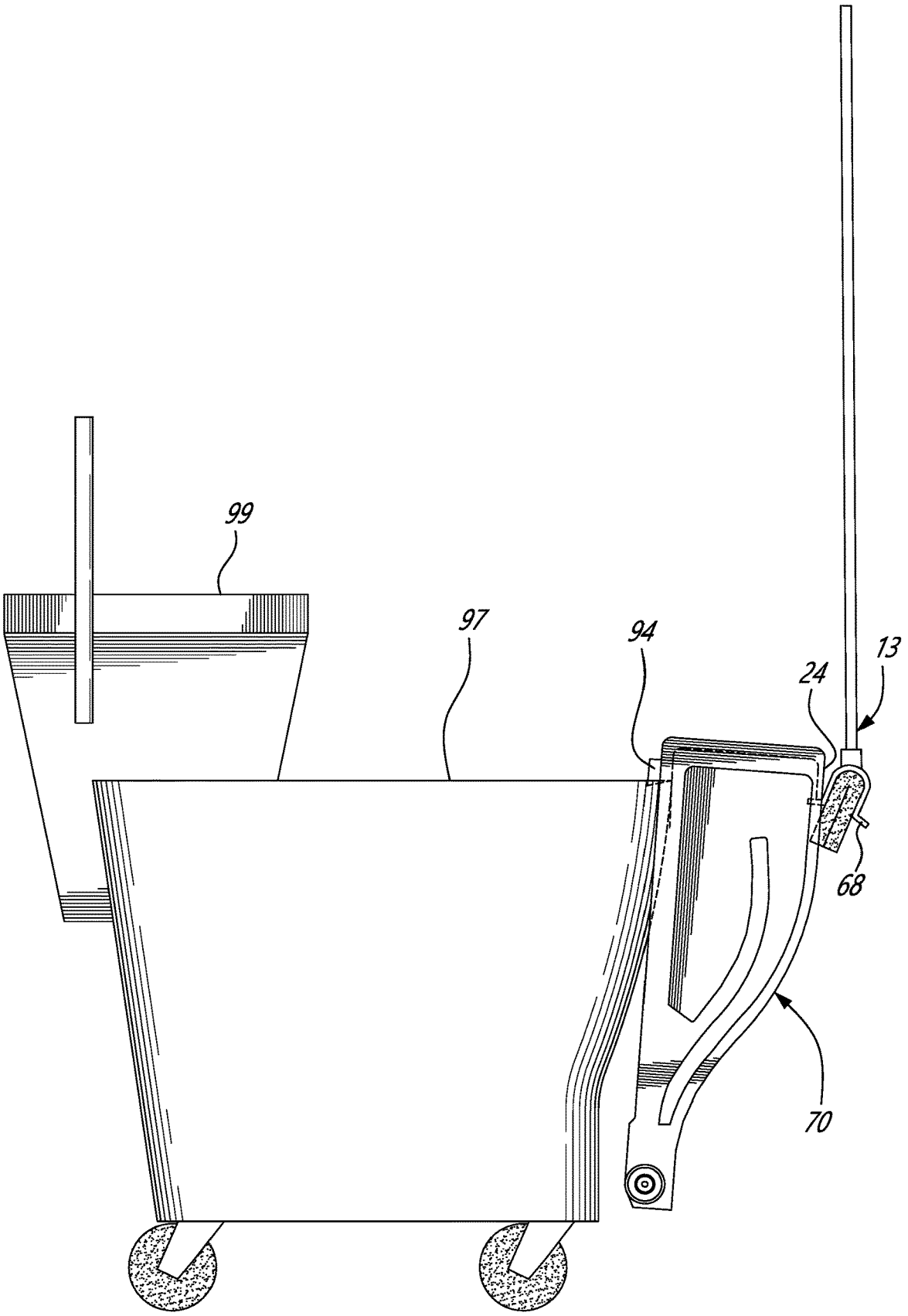
FIG. 10 is a side elevation of the device from FIG. 5, hanging from the bucket from FIG. 9, and further illustrating a squeegee hooked to the handle portion of the device during transport of the ensemble.

FIG. 10 shows the device 70 hung by its leg 94 to the edge of a mop bucket 97 with wringers 99. In this configuration, the squeegee 13 can be mounted to the flange 24 of the device 70 via the bottom flange 68 of its blade.

As a further difference between the devices 10 and 70, the inner side of the side walls 86 of the device 70 are provided with arcuate grooves that guidingly receives the lateral edges of the ramp 78. The grooves yield embossment portions 100 on the exterior side of the walls, which can further serve as gripping portions to help handling and carrying the device 70.

Figure 8:
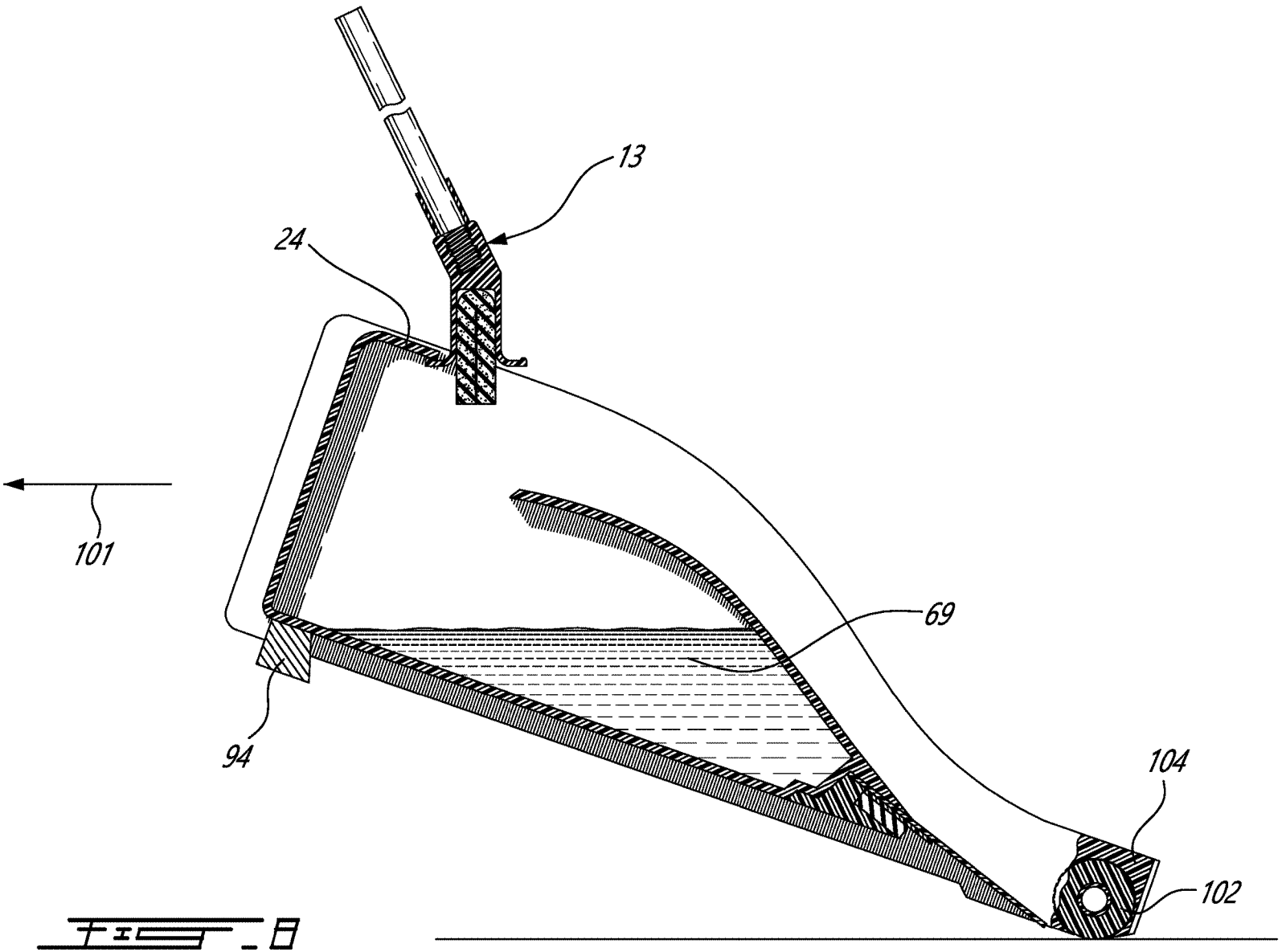
FIG. 8 is a cross-section of the device from FIG. 5, illustrated with a squeegee that is used to pull on the device.

A wheel 102 is rotatably mounted to the exterior side of each side walls 86 near the front thereof. As shown in FIG. 8. The wheels 102 facilitate pulling (see arrow 101) or pushing of the device 70 when the device 70 is raised via its flange 24 using for example the squeegee 13. The wheels 102 further act as friction-reducing elements to limit wear. According to another embodiment (not shown), the wheels 102 are replaced by removable portions which can be replaced when they are wear out.

The portions 104 of the side walls 86 that extend longitudinally beyond the bottom edge of the ramp 78 are bent outwardly generally perpendicularly to the walls 86. These portions 104 serve liquid barrier.

Figure 11:
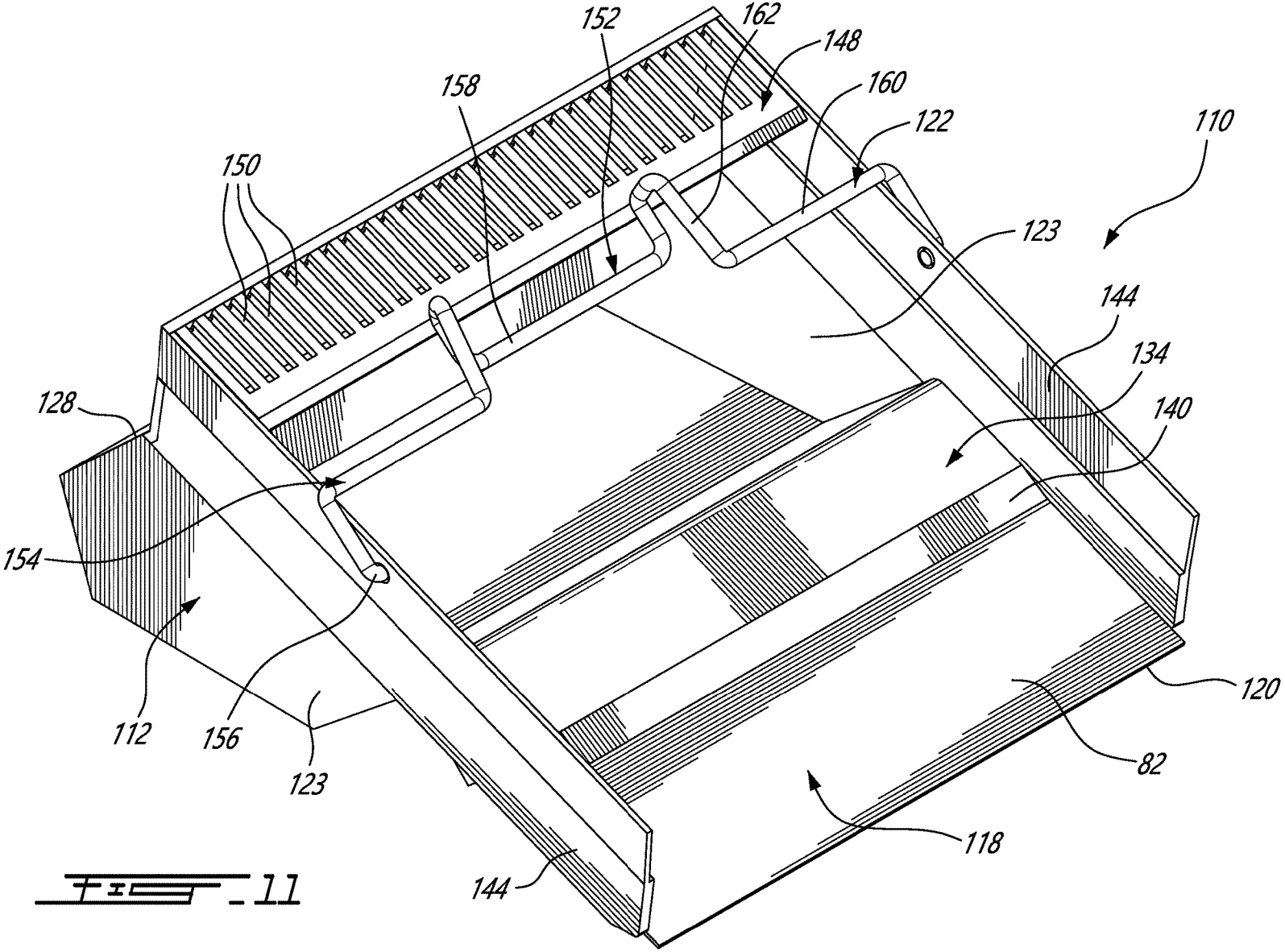
FIG. 11 is a front perspective view of a portable device for receiving a liquid from a surface according to a third illustrated embodiment.
Figure 12:
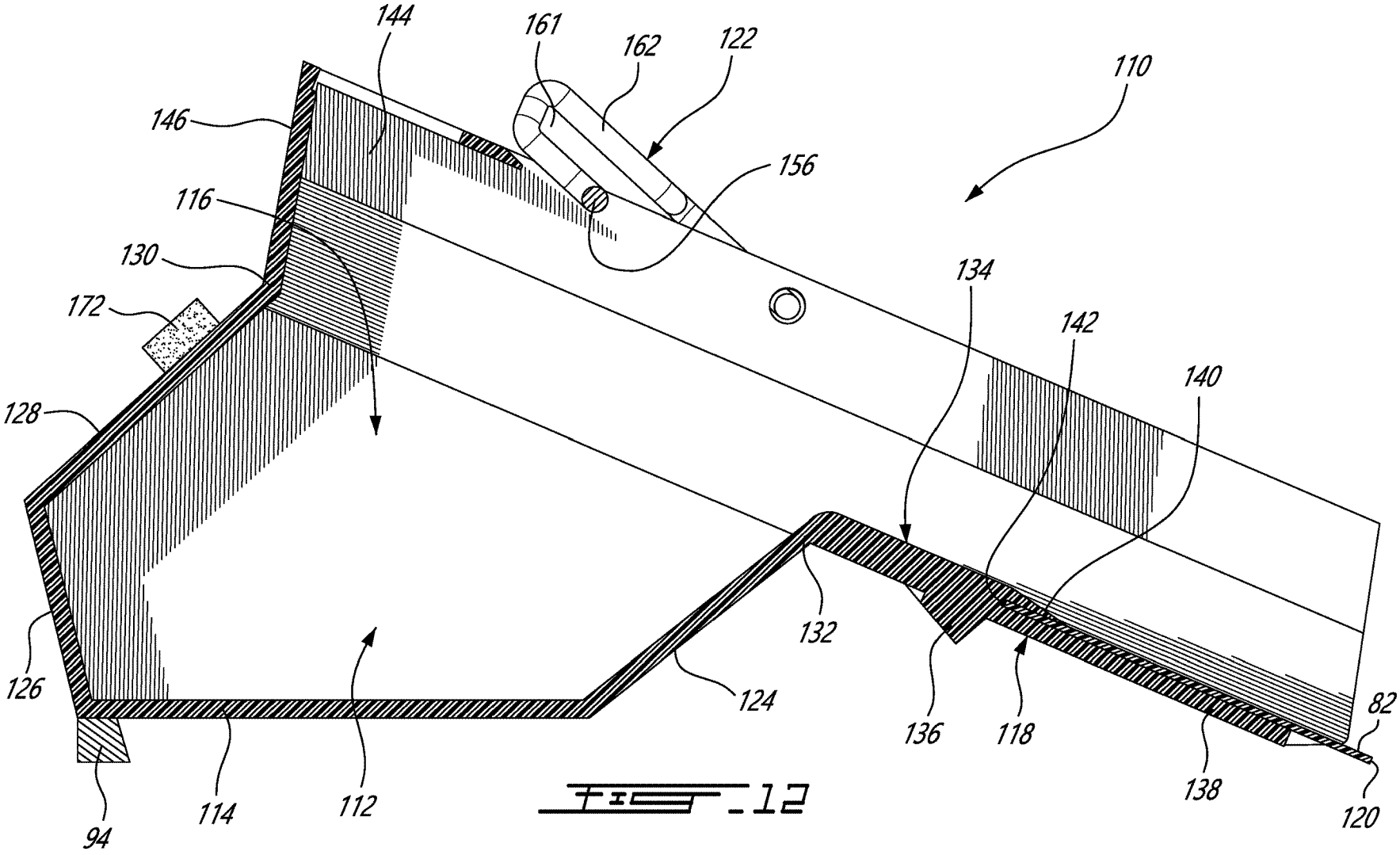
FIG. 12 is a cross-section of the device from FIG. 11.

Turning now to FIGS. 11 and 12, a device 110 for receiving a liquid from the floor according to a third illustrative embodiment will be described. Since the device 110 is similar to the devices 10 and 70, only the differences therebetween will be described herein in more detail for concision purposes.

The device 110 comprises a container 112, having a bottom 114 and an opening 116 that is distanced from the bottom 114, a ramp 118 that extends from the opening 116 of the container 112 to a free edge 120 positioned generally levelled with the bottom 114, and a handle 122 that is more distanced from the bottom 114 of the container 112 than from the opening thereof 116.

The container 112 has a pentagonal cross section and includes two lateral side walls 123, a front and a back wall 124 and 126, each defining an obtuse angle with the bottom 114. An upper back wall 128 extends upwardly from the lower back wall 126 generally parallel to the front wall 124. The relative angle of the two back walls 126 and 128 and their lengths are such that the upper edge 130 of the upper back wall 128 is higher than the edge 132 of the front wall 124 relative to the bottom 114, yielding a slanted container 112 that has a raised back relative to its front.

The ramp 118 includes a fixed portion 134 that integrally extends from the front wall 124 of the container 112 and a blade 82 that is removably mounted to the fixed portion 134 so as to continuously extend therefrom in an overlaying manner.

The fixed portion 134 includes a thickening 136 near its center that contributes to adding rigidity to the overall ramp 118, a thin planar portion 138 that integrally extends from the enlargement 136, and a tapered portion 140 that briefly extends from the enlargement 136 and that defines a slot 142 therewith that is dimensioned to receive the blade 82.

A lateral side flange 144 portion extends continuously from each respective side wall 112 of the container 112 upwardly therefrom, and further extends on a respective side of the fixed portion 134 of the ramp 118 integrally therefrom. Similarly, a back flange portion 146 extends upwardly from the upper back wall 128. The lateral side and back portions 144-146 defines a U-shaped flange for the container/ramp ensemble. As already explained hereinabove, such a flange 146 serves both purposes of defining a constrained passage for the liquid and squeegee 13 and a guard therefor.

A top flange 148 is provided at the back of the device 110 which extends from the back flange 146 generally parallel to the ramp 118 between the two lateral side flanges 144. The flange 148 is provided with a series of parallel slots 150 defining a grate. The grate 148 contributes keeping sufficiently large debris collected with the liquid within the container 112 when the device is tilted towards the back more than ninety (90) degrees so as to be emptied.

The grate 148 can be provided with differently sized, shaped or positioned holes than the illustrated longitudinal slots 150. As shown hereinabove, such holes or slots can also be omitted.

The handle 122 includes a middle portion 152 which is laterally distanced from the lateral side flanges 144 and pivotally mounted thereto by J-shaped stem 154. Each lateral side flange 144 includes a hole that freely receives the short leg 156 of the stem 154 for pivot movement therein.

The middle portion 152 of the handle includes a straight portion 158 that is generally centered along the width of the device 110. The middle portion 152 is attached to the long leg 160 of the stem 154 via U-shaped rod portions 162 that further serves the purpose of distancing the middle portion 152 from the long leg 160 of the stem 154, defining a slot 161 therebetween.

The width and configuration of the handle 122 are such that it remains attached to the flanges 144 by compression.

According to another embodiment (not shown), attachments or brackets can be provided to secure the handle 122 to the flanges 144.

Figure 14:
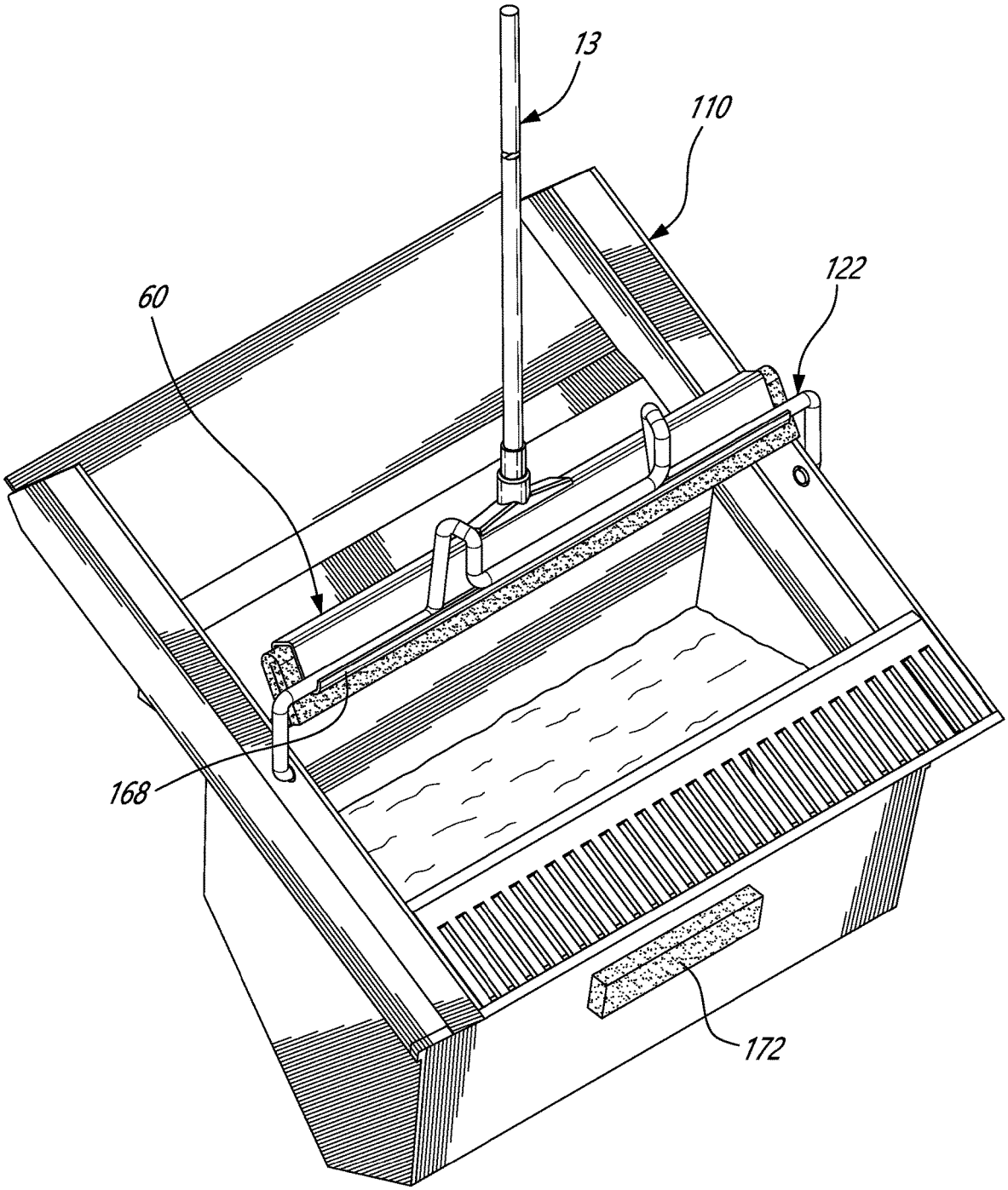
FIG. 14 is a front perspective of the device from FIG. 11, illustrating the complementary cooperation of the handle with a squeegee.
Figure 15:
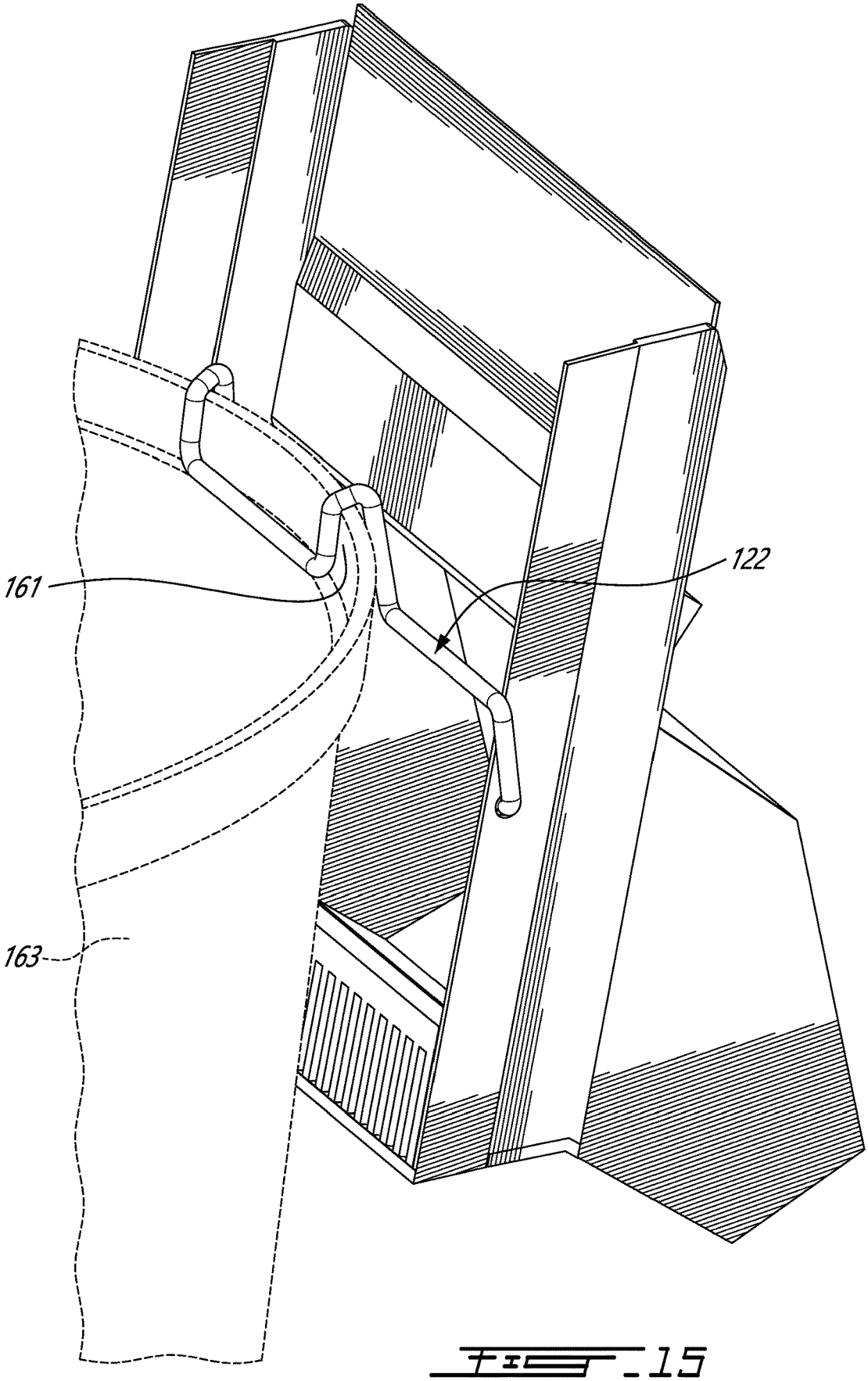
FIG. 15 is a perspective view of the device from FIG. 11, illustrating the use of the handle to hang the device from a bucket during storage or transport.
Figure 16:
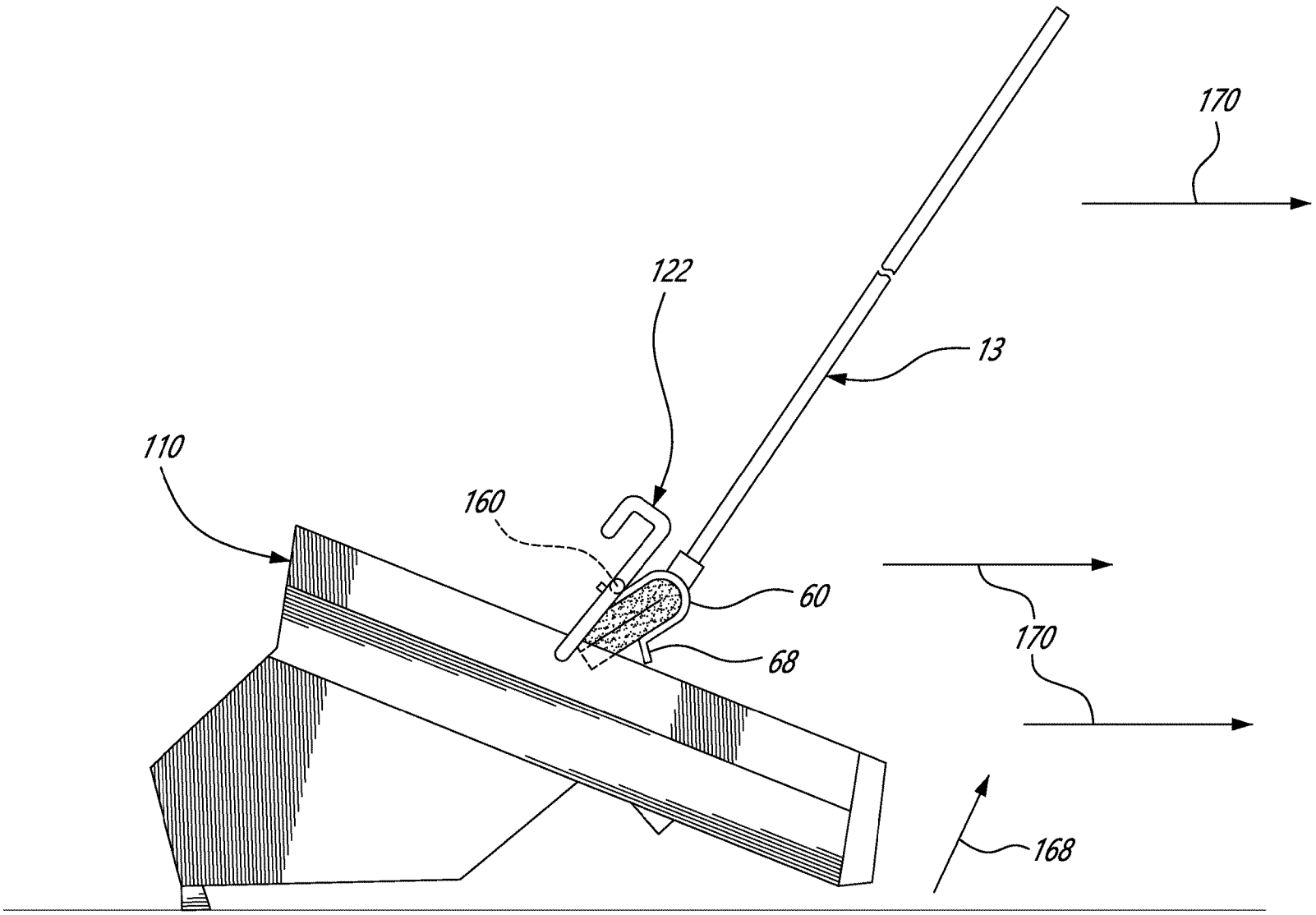
FIG. 16 is a side elevation of the device from FIG. 11, illustrating the use of the handle to move the device with a squeegee.
Figure 17:
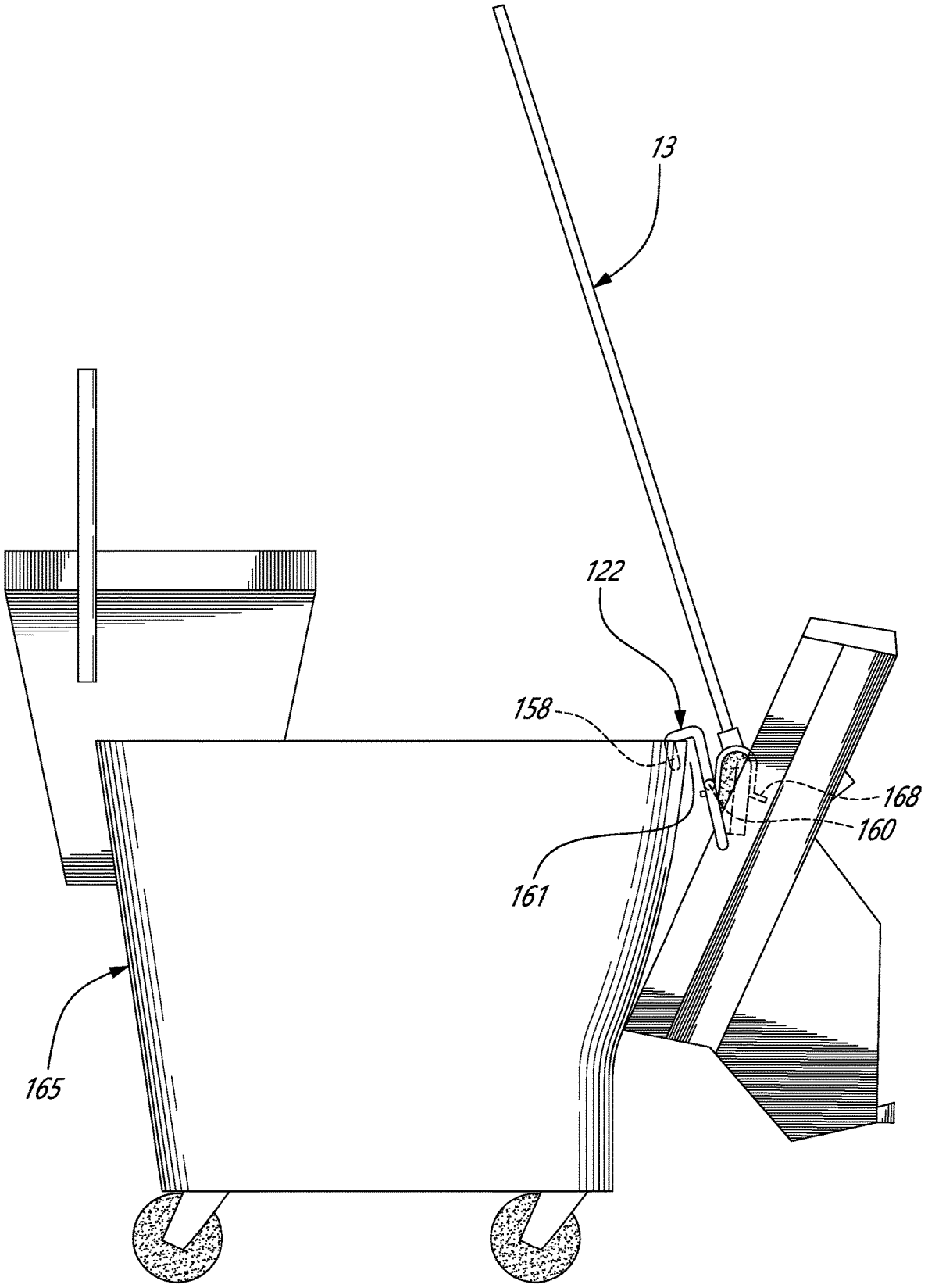
FIG. 17 is a side elevation of the device from FIG. 11 hanging from a bucket, and further illustrating a squeegee hooked to the handle portion of the device.

As illustrated in FIGS. 15 and 17, the slot 161 defines a hook portion that can be used to hang the device 110 to a bucket 163 or 165 or else, for transport or storage purposes. As shown in FIGS. 14 and 16, the straight portions 160 of the handle 122 allows receiving the bottom flange 168 of the squeegee blade mounting bracket 60 that then acts as a cooperating hook to grip the container 110. As can be further seen in FIG. 16, the squeegee 13, cooperating with the handle 122 in such a matter, can be used to slightly raise the device 110 (see arrow 168) that can then be easily moved by pulling on the squeegee 13 (see arrows 170).

As described hereinabove with reference to FIG. 3, the handle portion 148 can further be used in a cooperating manner with the squeegee 13 to raise and transport the device 110.

Figure 13:
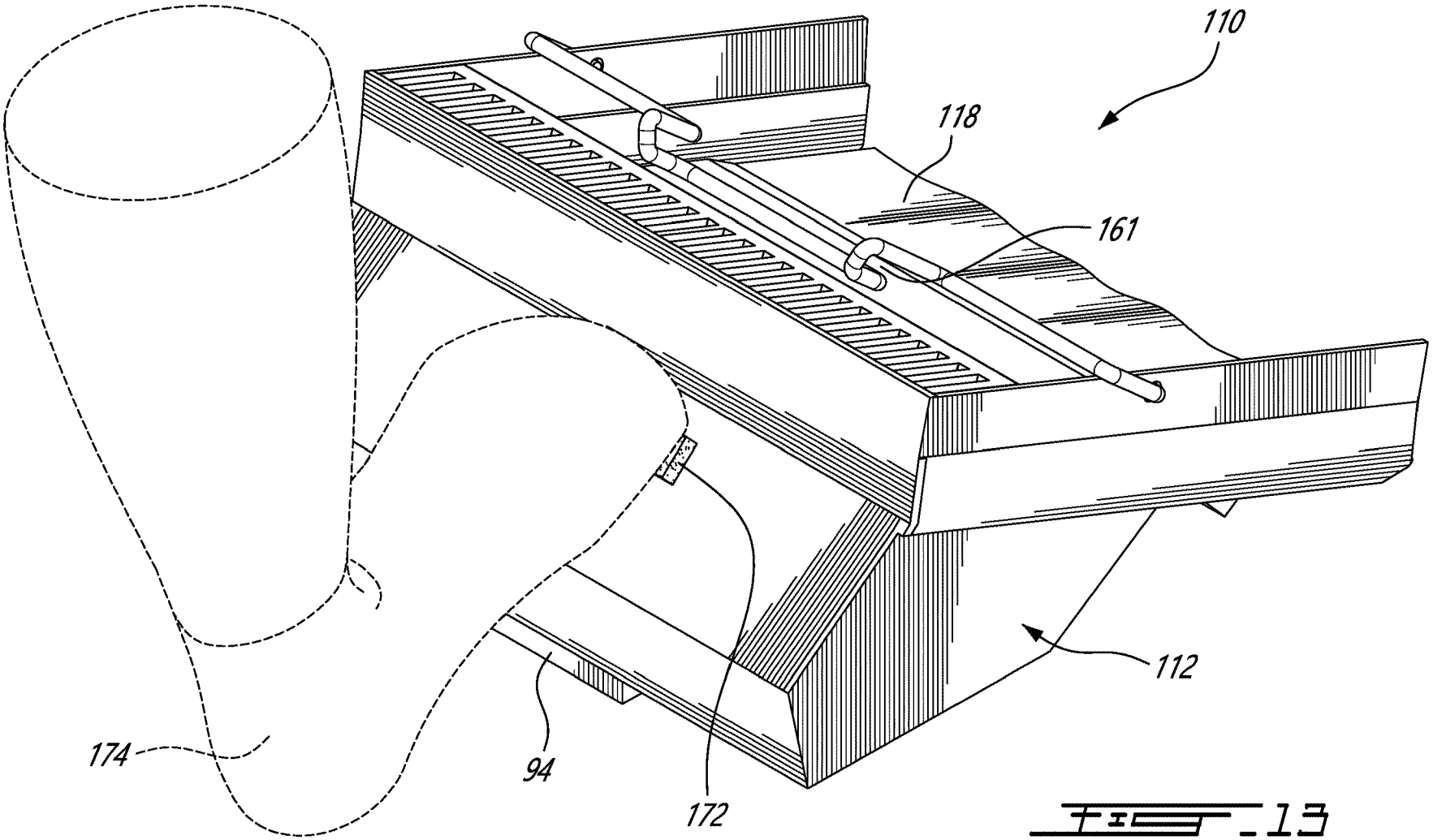
FIG. 13 is a back perspective of the device from FIG. 12, illustrating the use of the foot receiving element on the back to stabilize the device during the collect of liquid.

The device 110 further includes a friction element 172 secured to the upper back wall 128 so as to be generally centered laterally. The friction element 172 is in the form of a rubber block that is fastened to the wall 128 using for example an adhesive. As shown in FIG. 13, the friction element 172 can be used to receive the foot 174 of a user to prevent any movement of the device 110 for example when heavy pieces of debris are moved therein using the squeegee 13.

The device 110 is so configured that it automatically tilts so that the upper edge of its flanges are positioned at the horizontal whenever it is held by its handle 122.

Figure 18:
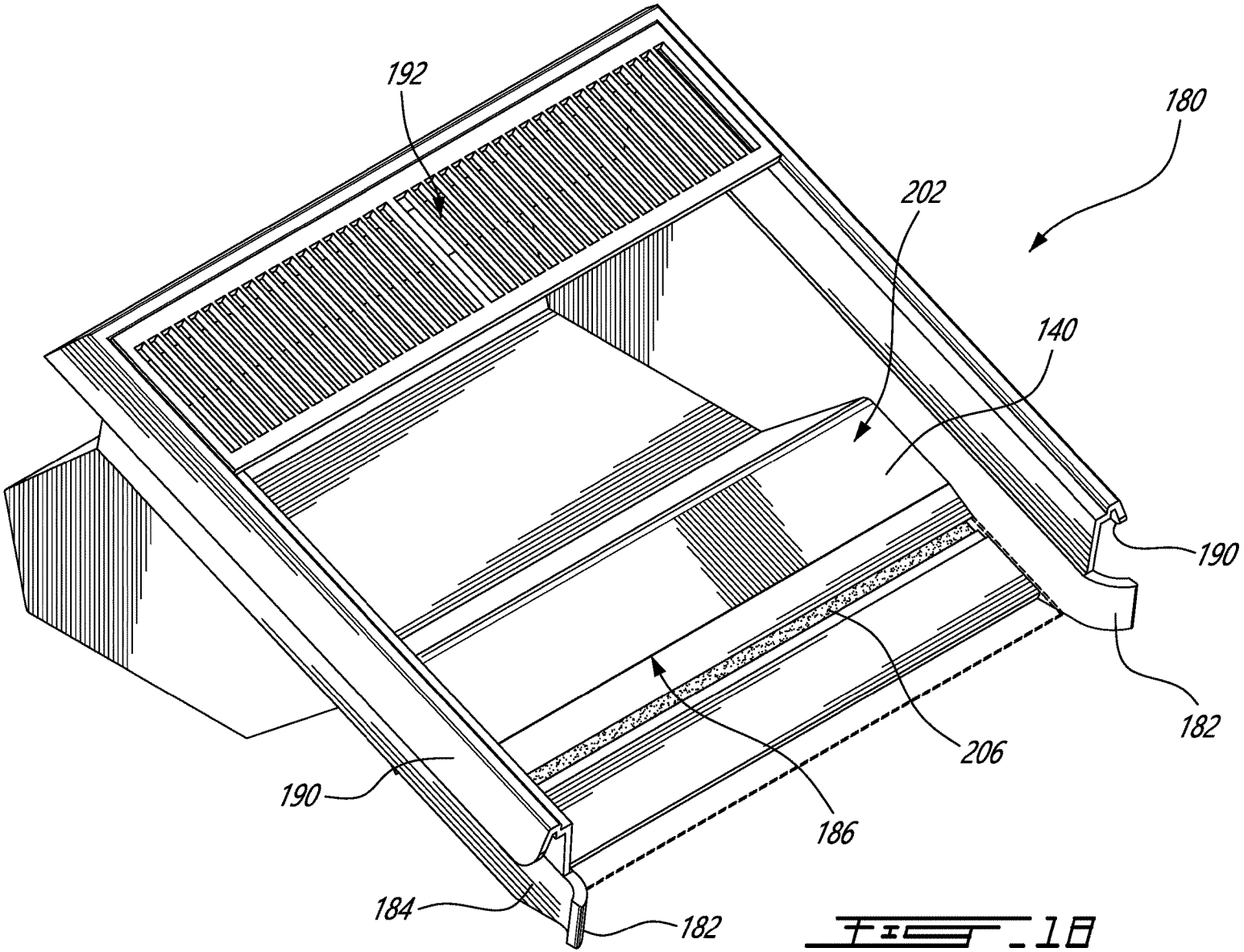
FIG. 18 is a top perspective view of a portable device for receiving a liquid from a surface according to a fourth illustrated embodiment.

With references to FIGS. 18 and 19, a device 180 for receiving a liquid from the floor according to a fourth illustrative embodiment will be described. Since the device 180 is similar to the device 110, only the differences therebetween will be described herein in more detail for concision purposes.

Similarly to the device 10, the portions 182 of the side walls 184 that extend longitudinally beyond the bottom edge of the ramp 186 are bent outwardly so as to define a widened entrance for the squeegee 13.

The upper portions of the side walls 184 and back wall 188 include a skirted flange 190, which can be used as gripping portions. These portions further act as structural reinforcement for the device 180.

Figure 19:
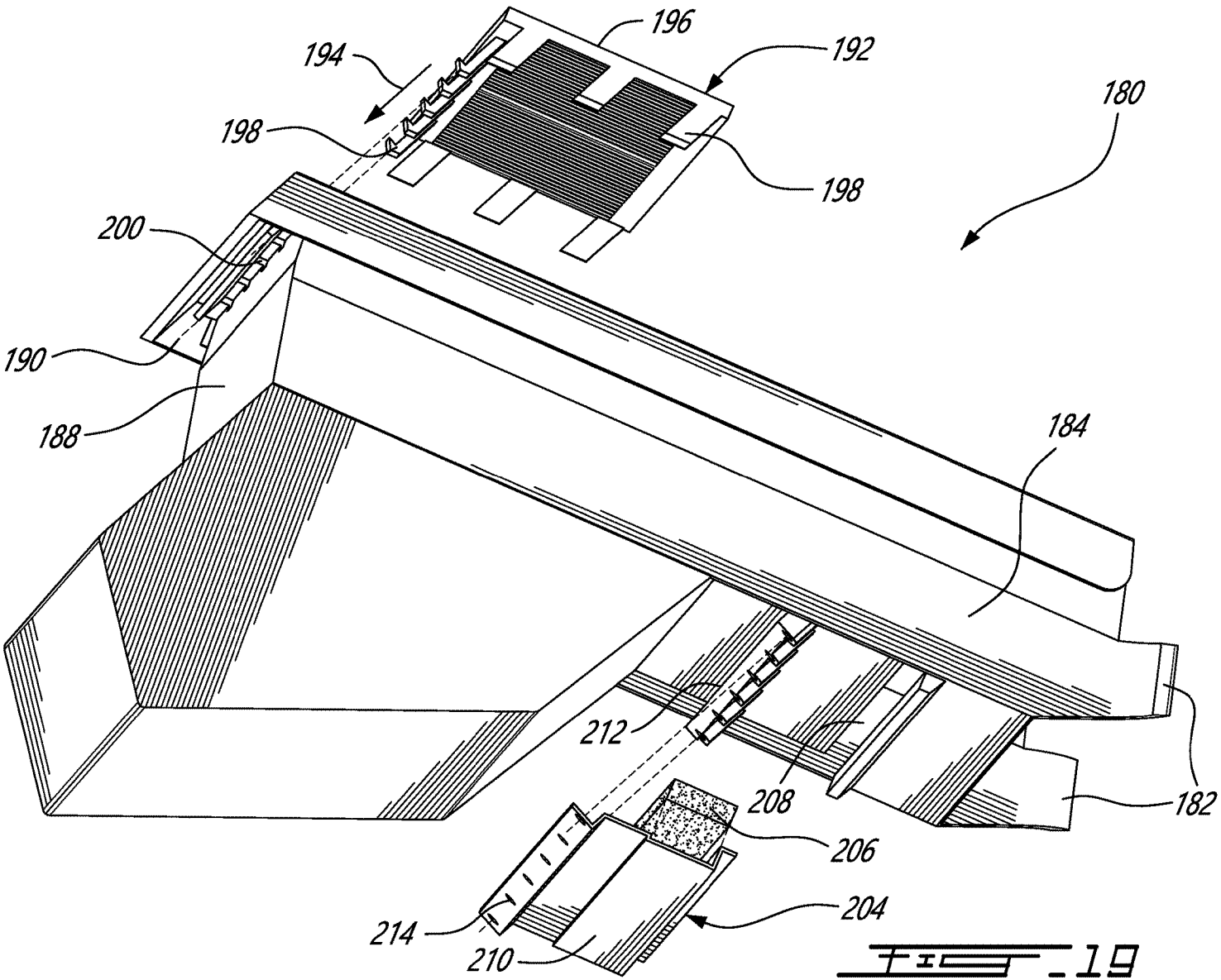
FIG. 19 is bottom perspective view of the device from FIG. 18, illustrative the removable mounting of both the filtering grate and the flexible blade.

As can be better seen in FIG. 19, the grate 192 is mounted to the peripheral walls 184 and 188 in a snap fit manner (see arrow 194). More specifically, the periphery 196 of the grate 192 includes hooked tabs 198 that are received in cooperating holes 200 in the skirted flange 190.

According to another embodiment (not shown), the grate 192 is secured to the skirted flange 190 using other cooperating elements than hooked tabs.

The removable blade 82 is biased towards the fixed portion 140 of the ramp 202 and secured thereto as an extension thereof by a mounting assembly 204. The mounting assembly 204 includes an elongated resilient element 206 having a width similar than the ramp's 202, which is forced by a removable mounting bracket 210 towards an elongated opening 208 practiced within the fixed portion 140 of the ramp along its full width. The bracket 210 is mounted to the fixed portion 140 of the ramp 202 thereunder in a snap fit manner using cooperating elements 212 and 214.

To change or reposition the removable blade 82, the mounting assembly 204 is disassembled from the fixed portion of the ramp 202, releasing pressure from the blade 82 which can then be removed. The blade 82 is then repositioned or a new one is inserted in the opening 208 and moved at the desired longitudinal position along the ramp, and the mounting assembly 204 is re-attached to the fixed portion 140 of the ramp 202.

It is to be noted that many modifications could be made to the portable device for receiving a liquid from a floor surface described hereinabove, for example:

- the width, depth, length and or proportion of the container is not limited to the illustrated embodiment and can be adapted to a specific application or usage;
- any one of the configuration and size of the ramp and side walls can be different than illustrated and described herein;
- the opening is not limited to having a rectangular shape and its dimension may also vary;
- the container can be made of any number of parts, each made of any rigid or semi-rigid material.

Although the present device for receiving a liquid from a floor via a squeegee has been described hereinabove by way of illustrated embodiments thereof, it can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. A device for receiving a liquid from a floor via a scraping implement, the device comprising:

a container having a bottom, two lateral side walls secured to the bottom so as to extend upwardly therefrom and a back wall extending upwardly from the bottom between the two lateral side walls near a first longitudinal edge of the bottom;

a ramp that extends laterally between the two lateral side walls; the ramp further extending from i) a low position that is substantially levelled with the bottom and that is longitudinally distanced from the bottom, to ii) a high position that is higher than the bottom of the container and substantially longitudinally distanced from a second longitudinal edge of the bottom; the ramp being adapted to receive the scraping implement in a scraping movement thereon;

a flange that extends from a free edge of the back wall in a direction towards the second longitudinal edge of the bottom and along the width of the container; the flange defining a handle that is adapted to receive a hook portion of the scraping implement so as to simultaneously raise and transport the device therewith; an opening of the container being defined by a gap between the high position of the ramp and the flange; the container, opening thereof and the flange being configured and relatively positioned to prevent a liquid in the container from spilling during said raising and transporting of the device; and at least one leg secured to the bottom thereunder near the first longitudinal edge; the at least one leg being centered laterally; the at least one leg defining a friction element to contribute stabilizing the device during the scraping movement of the scraping implement.

2. The device as recited in claim 1, wherein; the ramp defining a top wall of the container.

3. The device as recited in claim 1, wherein the flange includes openings therein.

4. The device as recited in claim 2, wherein the device is assembled from a one-piece center portion including the ramp, the bottom, the back wall and the flange, and from the two lateral side walls, which are sealingly secured to the one-piece center portion.

5. The device as recited in claim 4, wherein an inner side of each of the two lateral side walls includes a groove that receives a corresponding side edge of the ramp.

6. The device as recited in claim 1, wherein the container further comprising a friction element secured on an outside face of the back wall.

7. The device as recited in claim 1, wherein the two lateral side walls extend downwardly below the bottom.

8. The device as recited in claim 1, wherein each of the two lateral side walls includes a portion that extends longitudinally beyond the ramp; the ramp extending downwardly below the two lateral side walls.

9. The device as recited in claim 8, wherein each portion of the two lateral side walls that extends longitudinally beyond the ramp is bent laterally outwardly.

10. The device as recited in claim 8, further including two wheels each being mounted to a respective one of the two lateral side walls on the portion thereof that extends longitudinally beyond the ramp.

11. The device as recited in claim 10, wherein each of the two wheels are mounted to the container on a respective side thereof adjacent the low position of the ramp.

12. The device as recited in claim 1, wherein the ramp is arcuate.

13. The device as recited in claim 12, wherein a free edge of the ramp is oriented towards the bottom.

14. The device as recited in claim 1, wherein the ramp includes a fixed portion secured to the container and a removable portion secured to the fixed portion and extending therefrom up to the position levelled with the bottom.

15. The device as recited in claim 14, wherein the removable portion of the ramp is in the form of a blade.

16. The device as recited in claim 15, wherein the blade is forced onto the fixed portion by a mounting assembly that is removably mounted to the fixed portion.

17. The device as recited in claim 16, wherein the mounting assembly includes a friction element that contacts the blade on a face thereof opposite the fixed portion of the ramp.

18. The device as recited in claim 14, wherein the fixed portion includes a slot adapted to receive the removable portion.

19. The device as recited in claim 18, wherein a strip of resilient material is further inserted in the slot to secure the removable portion of the ramp therein.

20. The device as recited in claim 1 which is at least partially made from a translucid polymeric material.

21. The device as recited in claim 1, wherein the at least one leg is tapered towards a side thereof in contact with the bottom.

22. The device as recited in claim 1, wherein the at least one leg defines a hook.

23. The device as recited in claim 1, wherein the handle is a first handle; the device further comprising a second handle that is pivotably mounted to the two lateral side walls therebetween.

24. The device as recited in claim 23, wherein the second handle includes a hook portion.

* * * * *